US007175042B2

(12) United States Patent
Durdon

(10) Patent No.: US 7,175,042 B2
(45) Date of Patent: Feb. 13, 2007

(54) DISPOSABLE CUP LID WITH RECLOSABLE AND RESEALABLE CONDIMENT TAB

(75) Inventor: Terry Durdon, Guelph (CA)

(73) Assignee: Amhill Enterprises, Mississauga (CA)

( * ) Notice: Subject to any disclaimer, the term of this patent is extended or adjusted under 35 U.S.C. 154(b) by 0 days.

(21) Appl. No.: 10/694,851

(22) Filed: Oct. 29, 2003

(65) Prior Publication Data

US 2005/0092748 A1 May 5, 2005

(51) Int. Cl.
*B65D 51/18* (2006.01)
*B65D 55/16* (2006.01)
*A47G 19/22* (2006.01)

(52) U.S. Cl. ..... 220/254.3; 220/711; 220/713; 220/716; 220/375

(58) Field of Classification Search ..... 220/254.1, 220/254.3, 254.7, 711, 713, 716, 717, 375; 229/404, 906.1
See application file for complete search history.

(56) References Cited

U.S. PATENT DOCUMENTS 4,350,260 A * 9/1982 Prueher ..... 220/254.3
5,894,952 A 4/1999 Mendenhall et al.
5,934,493 A 8/1999 Han
5,947,319 A * 9/1999 Sinski ..... 220/318
5,979,647 A 11/1999 Han
6,176,390 B1 * 1/2001 Kemp ..... 220/712
6,202,542 B1 3/2001 Melton
6,314,866 B1 * 11/2001 Melton ..... 99/322
6,679,397 B2 * 1/2004 Smith et al. ..... 220/254.1
6,708,735 B1 * 3/2004 Kenihan ..... 141/18
2003/0024930 A1 2/2003 Smith et al.
2003/0102312 A1 6/2003 Horner
2004/0060934 A1 * 4/2004 Haynes et al.

FOREIGN PATENT DOCUMENTS

GB 1060389 3/1967
GB 2322289 8/1998
GB 2375531 11/2002

* cited by examiner

*Primary Examiner*—Robin Hylton
(74) *Attorney, Agent, or Firm*—Gowan Intellectual Property

(57) ABSTRACT

A disposable cup lid for placement onto the rim of a drinking cup is provided. The cup lid comprises a cover portion having a drinking access port and a condiment opening, a rim portion, and a flexible arm having a sealing member. The cup lid is structured in such a manner that when the condiment opening is not in use, the condiment opening is sealably closed by the sealing member of the flexible arm.

16 Claims, 5 Drawing Sheets

DISPOSABLE CUP LID WITH RECLOSABLE AND RESEALABLE CONDIMENT TAB

FIELD OF THE INVENTION

This invention relates to cup lids, and more particularly relates to a disposable cup lid for covering the open end of a beverage cup, where the addition of condiments to the beverage is desirable by the consumer before the drinking of the beverage. The beverage cup may be used to carry hot beverages such as coffee, tea, hot chocolates, and the like, or it may be used to carry cold beverages such as ice tea, ice coffee, or cappuccino.

BACKGROUND OF THE INVENTION

With the ever increasing demands of our busy lives, more and more people are relying on the convenience of fast food and take-outs. Indeed, the fast food industry has significantly grown over the years, and this in turn has contributed to the growth of the manufacturing of the containers and lids used in holding and containing the food and beverages. One particular area of the fast food industry which has exploded in the recent decades is the sale of coffee, cappuccino, espresso, hot chocolate, tea and the like. These beverages are available both as hot beverages or cold beverages. They are usually sold at cafes, fast food restaurants, and drive-throughs, and are usually available to the consumers as take-away beverages. Beverages of this sort are typically contained in paper or polystyrene cups; and polystyrene plastic disposable cup lids are usually provided for placement over such cups.

Many variations of such disposable cup lids are available in today's market. The disposable cup lids may be relatively flat, or they may be domed or semi-domed. The domed or semi-domed type lids are particularly suitable for beverages such as cappuccinos, hot chocolates, and the like, which typically have some froth or foam at the top of the beverage when it is dispensed into the cup. In the case of cold beverages, the domed or semi-domed type lids provide additional volume for foam or for ice cubes which are floating in the beverage. Whether the lids are flat or domed, the lids are provided with a drinking opening so as to permit the consumer to drink the beverage contained in the cup without having to remove the lid. The opening may be a small drink-through opening that is pre-formed near the peripheral region of the cup lid. In another variation, the drink-through opening is defined by a tearable foldback tab. When the tab is torn and folded back, the drink-through opening is provided in the lid. In yet another variation, the tab may have to be torn off from the lid in order to create the drink-through opening.

A drawback of these conventional disposable cup lids is that the drinking opening provided is not sufficiently large enough for the consumer to add condiments such as sugar, cream, milk and spices into the beverage. The opening is designed to serve solely as a drink-through opening, and thus the size of the opening is typically quite small so as to prevent spills or splashes of the beverage from the cup. If the consumer wishes to add condiments into the beverage, he or she would be required to first remove the lid from the cup, and then add the condiments into the beverage. Since most consumers like to enjoy such beverages with at least the addition of some type of condiments, the conventional disposable cup lids do not allow the consumer to add the condiments to the beverage without having to first remove the lid from the cup. Removal of such disposable cup lid from a cup containing a full amount of beverage is difficult, inconvenient, cumbersome, and possibly dangerous in certain circumstances, especially when the consumer is driving, riding in a vehicle, or walking. The difficulty of removing the cup lid is further exacerbated when the beverage contained within the cup is a hot beverage. The consumer purchased the beverage as a take-out item, and as such, the lid and the container provided need to be durable and spill-resistant so as to permit the consumer to be able to carry the beverage around safely.

Attempts have been made to provide disposable cup lids having not only a drink-through opening, but also another port for the consumer to add condiments into the beverage. However, disposable cup lids of this type which are currently available are not very effective, particularly, in sealing the condiment port after the addition of the condiments into the beverage. Since the condiment port is a relatively large opening, the condiment port needs to be closed and sealed after the addition of condiments into the beverage in order to avoid splashes, and spills while the consumer is drinking the beverage or holding the beverage while performing other activities.

In U.S. patent application Publication No. 2003/0102312 published to HORNER on Jun. 5, 2003, a disposable lid with a cream and sugar port is taught. The disposable lid is structured in such a manner that when placed on a disposable cup, the user may add condiments to the beverage in the cup without having to remove the lid from the cup. The condiment port is on the opposite side of the lid from the drinking port. Furthermore, the condiment port is defined by a slit which is oriented perpendicularly to an imaginary line that runs through the center of the lid between the drinking port and the condiment port. When the condiment port is in use, the cap can be selectively deformed by the user to create an opening sufficient to allow the introduction of condiments into the cup. When the deforming pressure is removed, the cap is biased to return to its original closed position. In the closed position, the condiment port is substantially blocked by a resilient cap that is unitarily formed as part of the cover. While the cap substantially blocks the condiment port when the cap is in its closed position, the cap does not sealingly engage the condiment port so as to prevent leakage of beverage from the cup when the cup is agitated.

U.S. Pat. No. 5,894,952 issued to MENDENALL et al. on Apr. 20, 1999 teaches a spill-resistant cup lid with condiment funnel and stirring rod. The lid is adapted for use with a beverage container having a hot beverage held within. The lid has a drink-through opening in the form of an arcuately shaped spout, located adjacent the upper peripheral rim of the cup lid. A condiment funnel opening is located near the center of the lid which serves to channel excess beverage back into the cup, and also through which condiments may be poured into the cup. A stirring rod with a hemispherically shaped flange disposed near the upper portion of the rod is provided. The hemispherical flange rests in the condiment funnel opening and aids the consumer in stirring the beverage. The hemispherical flange helps thermally seal the cup lid to decrease heat loss from the hot beverage. Since the stirring rod with the hemispherical flange is a separate entity from the cup lid, the stirring rod could be misplaced or inadvertently discarded by the user after stirring the condiments into the beverage. As such, the condiment funnel opening is no longer sealed. Spillage and leakage of beverage from the cup result.

In U.S. Pat. No. 5,934,493 issued to HAN on Aug. 10, 1999, a lid for a beverage container is taught. The lid has a flexible disk-like body and a plurality of slot openings formed in the body. Each of the slot openings is adapted to receive a small container containing additives, such as sugar or cream. Upon application of pressure, the slot opening which is defined by a plurality of intersecting lines breaks open. Near the slot opening, the lid also has protrusions formed therein which create an opening in the container as the container is inserted into the slot opening. When the small additive container is inserted into the slot opening, a release opening is formed in the body of the additive container and the content contained therein is released. The lid as taught by HAN requires the condiments to be packaged in specifically sized additive containers which are compatible with the particular dimensions of such a lid. The consumer using the lid provided by HAN would not be able to use condiments contained in packages or containers currently exist in the market. If the specifically sized additive containers containing the condiments are not available, and the consumer need to use sugar and cream in existing packages or containers, the consumer nevertheless is required to remove the lid from the cup before adding the condiments to the beverage.

U.S. Pat. No. 5,979,647 issued on Nov. 9, 1999 also to HAN is a Continuation-In-Part patent of the above noted United States Patent. In this Continuation-In-Part patent, the inventor teaches a disposable lid for a container in which the lid has pre-stored additives such as sugar or cream contained therein. The lid includes a base member sized to fit over the container where the base member has at least one compartment region with a sealed outlet, and a cover sealing the compartment region to prevent the content from exiting the compartment region. When the cover is actuated, the outlet breaks open and allows the additive in the compartment region to flow into the container. Since each of the compartments has a pre-determined amount of condiments contained therein, once the cover is opened, the entire amount of the condiments contained in the compartment is released into the beverage. Thus, the consumer is not permitted to add a desired amount of condiments into the beverage suitable to the consumer's taste. Further, as soon as one of the condiments contained in such a lid is passed its expiry date, the entire lid has to be discarded which is very uneconomical.

It will be apparent from the foregoing prior art that the disposable cup lids have condiment ports formed therein, and such condiment ports are typically unsealed, and not reclosable. Further, it will be apparent from the foregoing prior art that the disposable cup lids have condiments pre-contained therein.

SUMMARY OF THE INVENTION

It is an object of the present invention to provide a novel cup lid which obviates or mitigates the disadvantages of the prior art.

In accordance with one aspect of the present invention, a cup lid for placement onto the rim of a drinking cup having a substantially circular opening at its upper end is provided. The cup lid of the present invention comprises a cover portion, a rim portion around the periphery of the cover portion and a flexible arm which is integrally formed with the rim portion and extending outwardly therefrom. The cover portion has a drinking access port and a condiment opening defined therein, the condiment opening being substantially opposite the drinking access port. The rim portion is sealingly securable to the upper end of the drinking cup. The flexible arm has a sealing member at an end remote from the rim portion for sealably closing the condiment opening when the condiment opening is not in use.

Preferably, the drinking access port is in the peripheral region of the cover portion. The flexible arm is adjacent to the condiment opening and separated therefrom by the rim portion.

In one embodiment of the present invention, the drinking access port provides a readily accessible drinking opening. In another embodiment of the present invention, the drinking access port is defined by a hanging chad such that when the hanging chad is dislocated downwardly from the drinking access port, a drinking opening is provided.

Further, the cover portion may have a recess formed therein, which is disposed in the region between the drinking access port and the condiment opening, for the accommodation of the lip of the consumer when the consumer is tilting the drinking cup and drinking from the drinking access port.

In one embodiment, the condiment opening has a stiffening rib around the peripheral region thereof, and the sealing member has a plug portion formed thereon which is dimensioned for fitment with the stiffening rib such that when the condiment opening is not in use, the plug portion of the sealing member frictionally engages with the stiffening rib so as to sealably close the condiment opening.

In another embodiment, the condiment opening is a punched through opening, and the sealing member has engaging means formed in the peripheral region thereof such that when the condiment opening is not in use, the engaging means of the sealing member frictionally engages with the cover portion surrounding the condiment opening so as to sealably close the condiment opening.

In a preferred embodiment of the present invention, the sealing member further has a tab outwardly extending therefrom which aids in the closing and opening of the condiment opening.

In a more preferred embodiment of the present invention, the cup lid further comprises a tab outwardly extending from the sealing member and diametrically opposed from the flexible arm such that when the condiment opening is sealably closed by the sealing member, the tab provides a cover for the drinking opening.

Typically, the rim portion has a channel defined therein, and a skirt downwardly extending therefrom such that when the cup lid is sealingly secured to the upper end of the drinking cup, the rim of the drinking cup is received in the channel of the cup lid and frictionally fitted therein.

The cup lid may be thermoformed from extruded plastics sheet material, wherein the cover portion, the rim portion, and the flexible arm have an extrusion grain, and wherein the flexible arm has a longitudinal axis which is substantially aligned with the extrusion grain.

In one embodiment of the present invention, the cup lid is dome shaped and is such that the cover portion is disposed above the rim portion.

In yet another embodiment of the present invention, the cup lid is flat and is such that when in use, the cover portion and the rim portion of the drinking cup lie substantially in the same plane.

Further, in one embodiment, the drinking access port is defined by a tearable fold-back tab such that when the fold-back tab is torn and folded back, away from the rim portion of the cup lid, the drinking opening is provided. The cup lid may be thermoformed from extruded plastics sheet material, wherein the cover portion, the rim portion, and the tearable fold-back tab have an extrusion grain, and wherein the tearable fold-back tab has a longitudinal axis which is substantially aligned with the extrusion grain.

In another embodiment, the drinking access port is defined by a tear tab such that when the tab is torn and dislocated away from the drinking access port, the drinking opening is provided. Moreover, the cup lid is thermoformed from extruded plastics sheet material, wherein the cover portion, the rim portion, and the tear tab have an extrusion grain, and wherein the tear tab has a longitudinal axis which is substantially aligned with the extrusion grain.

BRIEF DESCRIPTION OF THE DRAWINGS

The novel features which are believed to be characteristic of the present invention, as to its structure, organization, and use, together with further objectives and advantages thereof, will be better understood from the following drawings in which presently preferred embodiments of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

The present invention provides a cup lid for covering the open end of a beverage cup, where the addition of condiments to the beverage is desirable by the consumer before the drinking of the beverage. The beverage cup may be used to carry hot beverages such as coffee, tea, hot chocolates, and the like, or it may be used to carry cold beverages such as ice tea, ice coffee, or cappuccino.

Figure 1:
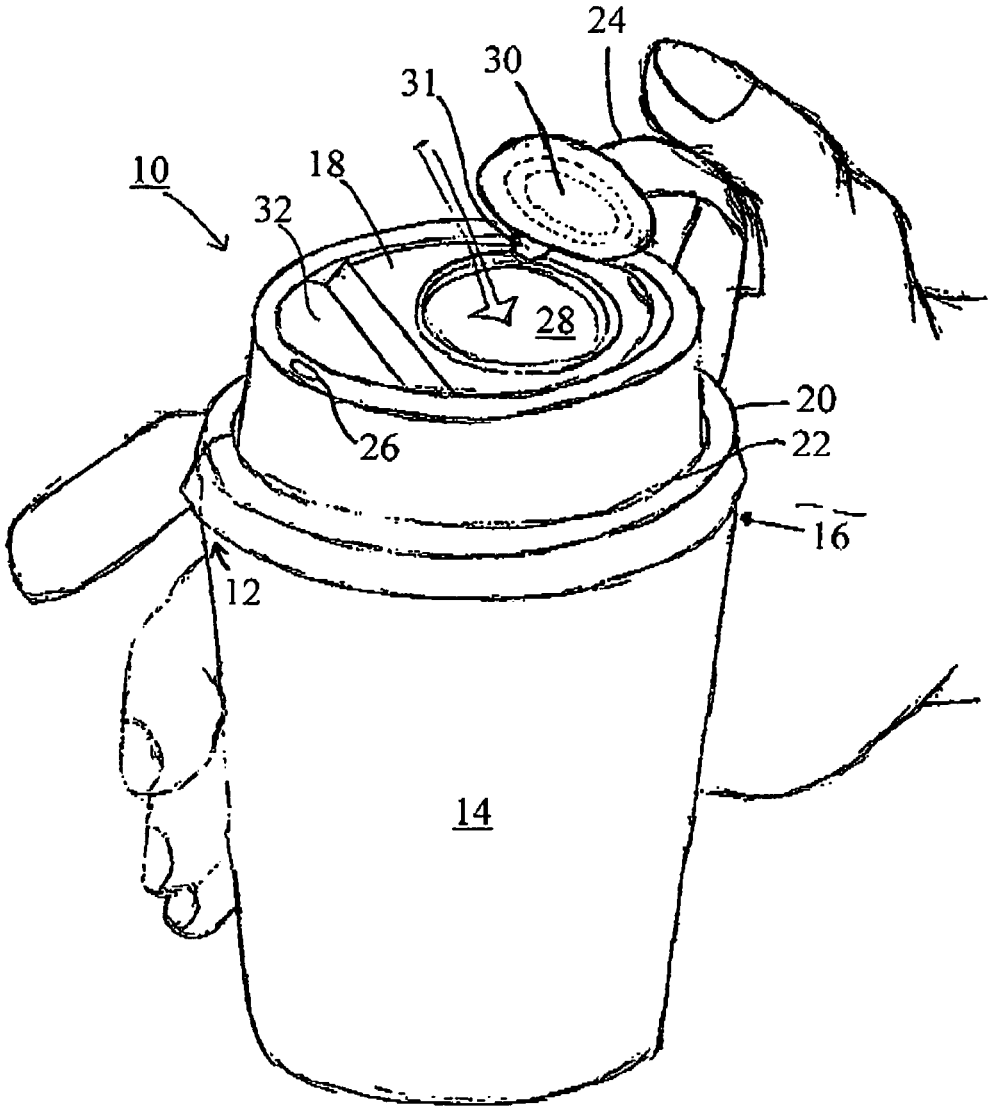
FIG. 1 is a perspective view of a first embodiment of a cup lid in keeping with the present invention, when the cup lid is placed onto the rim of a drinking cup having a substantially circular opening at its upper end.
Figure 2:
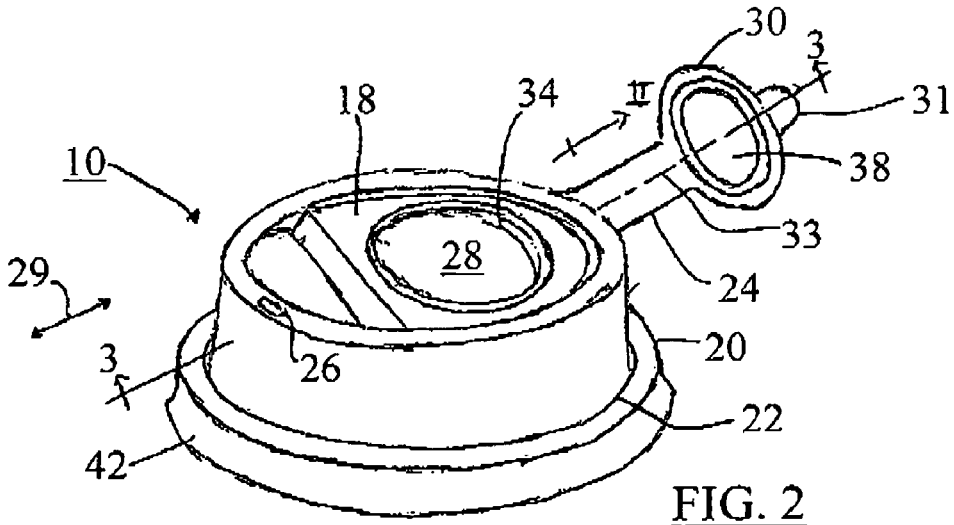
FIG. 2 is a perspective view of a first embodiment of a cup lid in keeping with the present invention, when the condiment opening is in its open position.
Figure 3:
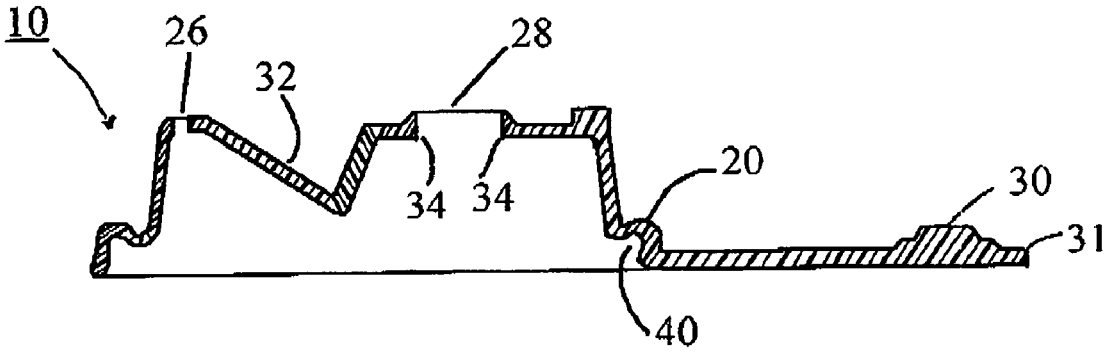
FIG. 3 is a cross-sectional view of a first embodiment of a cup lid in keeping with the present invention along line 3—3 in FIG. 2, when the condiment opening is in its open position.
Figure 4:
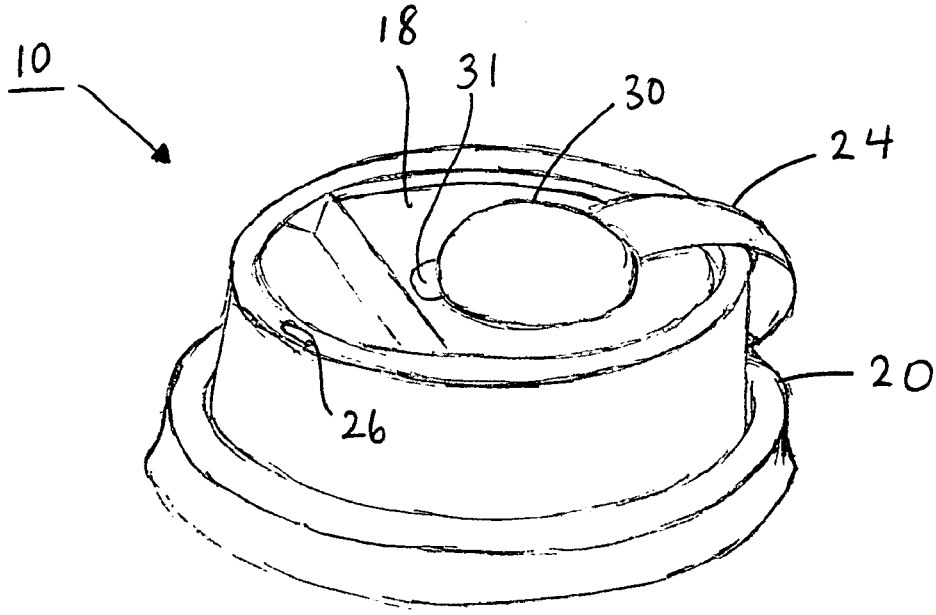
FIG. 4 is a perspective view of a first embodiment of a cup lid in keeping with the present invention, when the condiment opening is sealably closed by the sealing member of the flexible arm.

Referring first to FIGS. 1 to 4, a first embodiment of a cup lid in keeping with the present invention is shown. In FIG. 1, the cup lid 10 is shown being placed on the rim 12 of a drinking cup 14 which has a substantially circular opening at its upper end 16. The cup lid 10 comprises a cover portion 18, a rim portion 20 around the periphery 22 of the cover portion 18, and a flexible arm 24 integrally formed with the rim portion 20 and extending outwardly therefrom. The cover portion 18 has a drinking access port 26, and a condiment opening 28 defined therein. The condiment opening 28 is positioned substantially opposite from the drinking access port 26. The rim portion 20 is sealingly securable to the upper end 16 of the drinking cup 14, as can best be seen in FIG. 1. The flexible arm 24 has a sealing member 30 at an end remote from the rim portion 20 for sealably closing the condiment opening 28 when the condiment opening 28 is not in use (FIG. 4).

In the first embodiment of the present invention, the cup lid 10 is dome shaped. Such dome shaped cup lid 10 is particularly suitable for beverages which have some froth or foam at the top of the beverage when it is dispensed into the cup. In the dome shaped cup lid 10, the cover portion 18 is disposed above the rim portion 20.

The drinking access port 26 of cup lid 10 is in the peripheral region of the cover portion 18. The drinking access port 26 is substantially smaller in size than the condiment opening 28, and is of a size to permit ease of drinking. Typically, the drinking access port 26 of the dome shaped cup lid 10 is preformed. In the first embodiment of the present invention, the drinking access port 26 provides a readily accessible drinking opening.

In a preferred embodiment, the cover portion 18 of the dome shaped cup lid 10 of the present invention has a recess 32 formed therein, which is disposed in the region between the drinking access port 26 and the condiment opening 28. The recess 32 is designed to accommodate the lip of the consumer when the consumer is tilting the drinking cup 14 and drinking from the drinking opening 26.

As can be seen in FIG. 3, the flexible arm 24 is adjacent to the condiment opening 28 and they are separated from one another by the rim portion 20. Upon placement of the cup lid 10 onto the upper end 16 of the drinking cup 14 containing a beverage therein, the flexible arm 24 may be upwardly raised to almost 90 degrees from the rim portion 20 and then depressed by the thumb of the consumer such that the sealing member 30 of the flexible arm 24 engages the condiment opening 28 so as to sealably close the condiment opening 28 (FIG. 1). When the consumer wishes to return the condiment opening 28 to its open position, the sealing member 30 of the flexible arm 24 is disengaged from the condiment opening 28. Thus, opening and closing of the condiment opening 28 may easily be accomplished by moving the flexible arm 24 away and towards the condiment opening 28. Typically, the sealing member further has a tab 31 outwardly extending therefrom which aids in the closing and opening of the condiment opening 28. Thus, in most instances, only one hand of the user is required to open and close the condiment opening 28.

In a more preferred embodiment of the present invention, the condiment opening 28 has stiffening rib 34 around the peripheral region 36 thereof, and the sealing member 30 of the flexible arm 24 has a plug portion 38 formed thereon which is dimensioned for fitment with the stiffening rib 34. Thus, when the condiment opening 28 is not in use, the plug portion 38 of the sealing member 30 frictionally engages with the stiffening rib 34 so as to sealably close the condiment opening 28.

As best seen in FIG. 3, the rim portion 20 typically has a channel 40 defined therein, and a skirt 42 downwardly extending therefrom. As such, when the cup lid 10 is sealingly secured to the upper end 16 of the drinking cup 14, the rim 12 of the drinking cup 14 is received in the channel 40 of the cup lid 10 and frictionally fitted therein.

Figure 5:
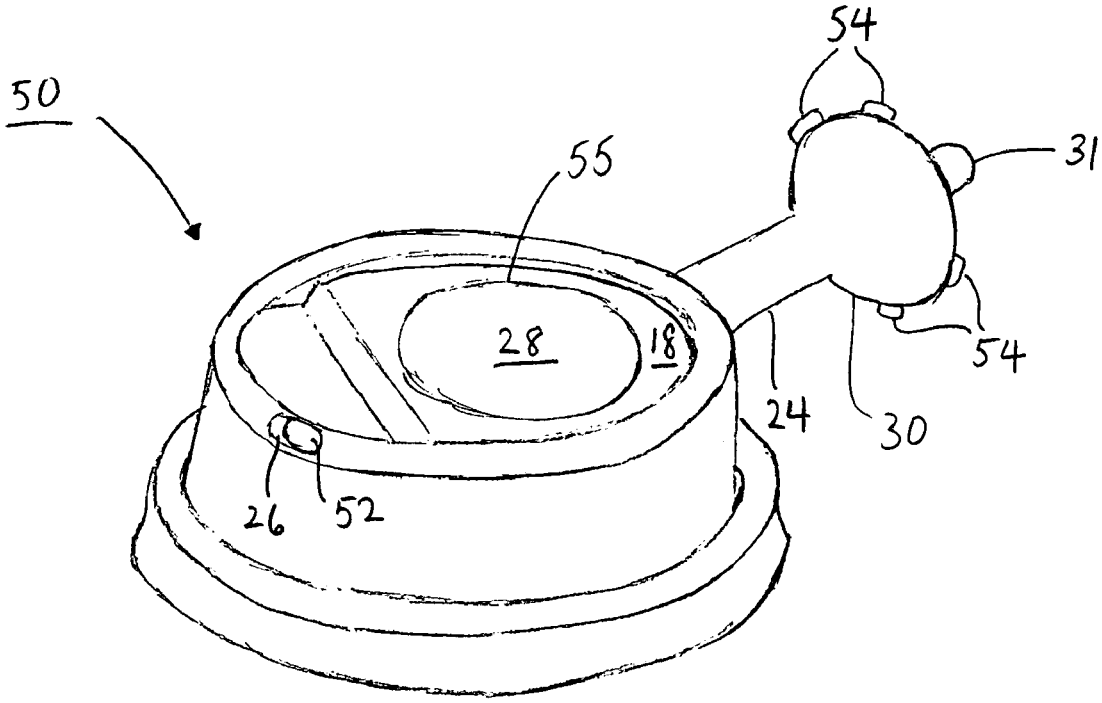
FIG. 5 is a perspective view of a second embodiment of a cup lid in keeping with the present invention, when the condiment opening is in its open position.

In a second embodiment of the present invention shown in FIG. 5, the drinking access port 26 of cup lid 50 is defined by a hanging chad 52. When the consumer is ready to consume the beverage in the drinking cup 14, the hanging chad 52 is dislocated downwardly from the drinking access port 26 such that a drinking opening is provided. In some instances, the hanging chad may be dislocated by simply applying a downward push onto it. An advantage offered by having such a hanging chad 52 is that it provides a slight obstruction to the passage of the beverage flow when the consumer is drinking from the beverage cup 14. Thus, the flow of the beverage from the beverage cup 14 is carried out in a more controlled manner.

As can also be seen in FIG. 5, the condiment opening 28 may be a punched through opening, and the sealing member 30 has engaging means 54 formed in the peripheral region thereof. When the condiment opening 28 is not in use, the engaging means 54 of the sealing member 30 frictionally engages with the underside of the cover portion 18, at the edge 55 of the condiment opening 28, so as to sealably close the condiment opening 28. The sealing member 30 and the condiment opening 28 is designed in such a manner that the outer perimeter of the sealing member 30 is slightly less than the perimeter of the condiment opening 28. As such, when the condiment opening 28 is closed off by the sealing member 30, the sealing member 30 is in a tight frictional relationship with the edge 55 of the cover portion 18.

Figure 6:
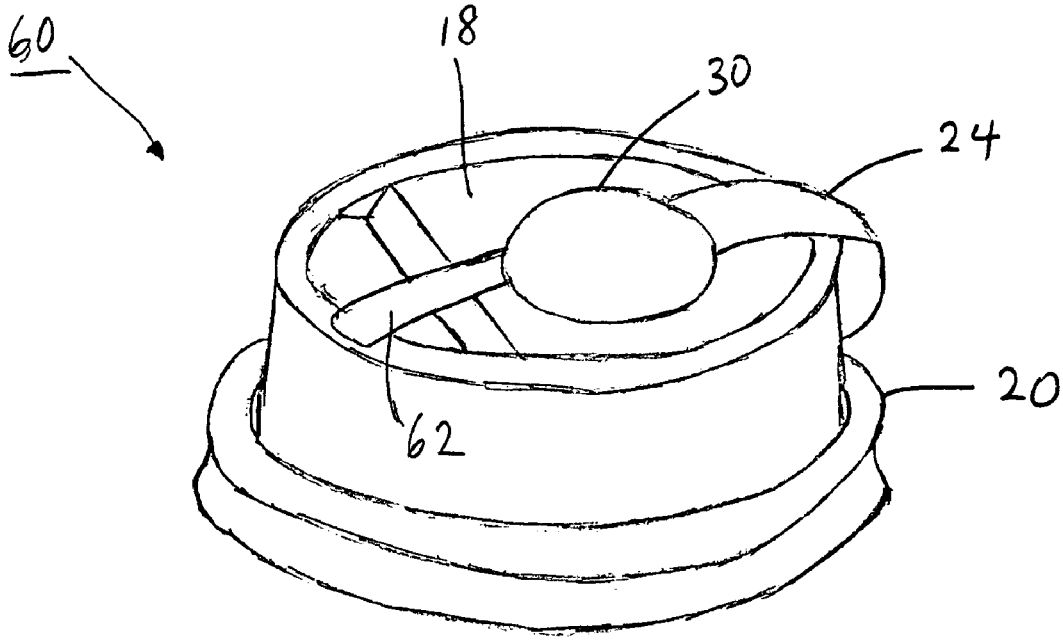
FIG. 6 is a perspective view of a third embodiment of a cup lid in keeping with the present invention, when the condiment opening is sealably closed by the sealing member.

In a third embodiment of the present invention shown in FIG. 6, cup lid 60 comprises a cover portion, a rim portion, and a flexible arm which are the same as the corresponding elements described in relation to FIGS. 1 to 5. In this particular embodiment, cup lid 60 not only provides a condiment opening 28 which may be opened or sealably closed, but it also provides a drinking access port 26 which may be opened or closed so as to avoid splashes and spills when the consumer is not drinking the beverage contained in the beverage cup 14. In this alternative embodiment, in order to provide an additional covering means for the drinking access port 26, cup lid 60 further comprises a tab 62 which is outwardly extending from the sealing member 30 and substantially diametrically opposed from the flexible arm 24. As can be seen in FIG. 6, when the condiment opening 28 is sealably closed by the sealing member 30, the tab 62 provides a cover for the drinking access port 26.

In a preferred embodiment of the present invention, the cup lid is of one piece construction, and is formed from a suitable plastic material. More preferably, the cup lid is thermoformed from extruded plastics sheet material, where the cover portion 18, the rim portion 20, and the flexible arm 24 have an extrusion grain as indicated by arrow 29, and is such that the flexible arm 24 has a longitudinal axis defined as arrow 33, which is substantially aligned with the extrusion grain.

Figure 7:
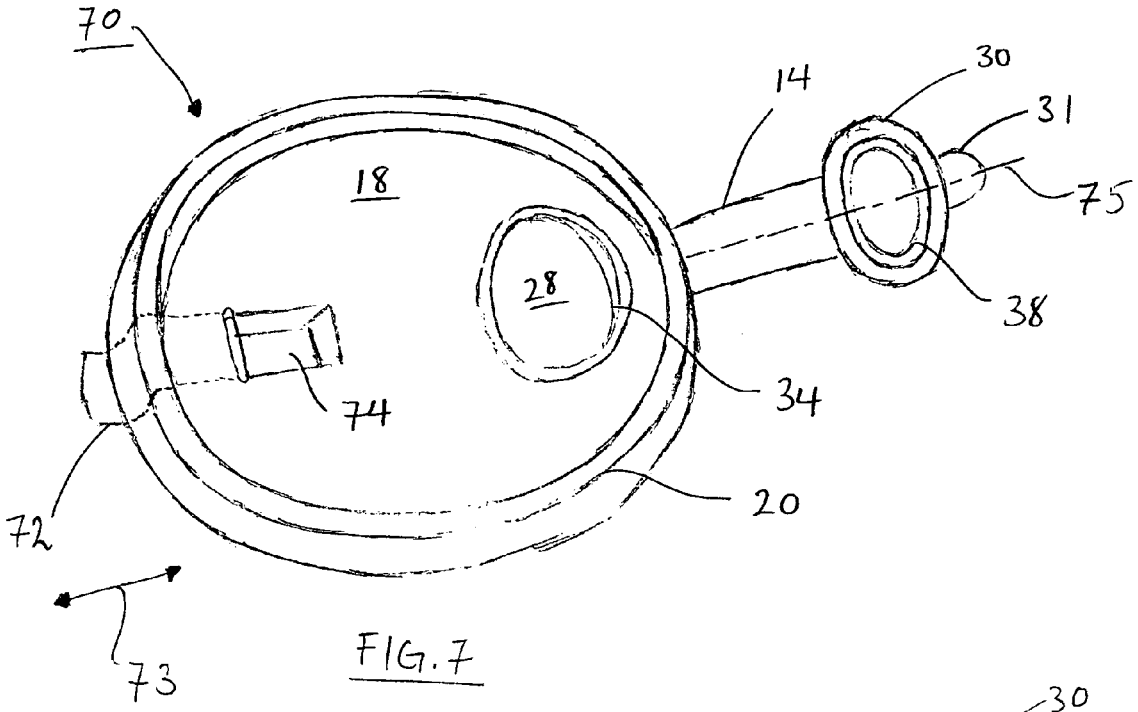
FIG. 7 is a perspective view of a fourth embodiment of a cup lid in keeping with the present invention, when the condiment opening is in its open position.

Turning now to FIG. 7, a fourth embodiment of the present invention is shown. Cup lid 70 comprises a cover portion, a rim portion, and a flexible arm which are the same as the corresponding elements described in relation to FIGS. 1 to 6. However, unlike previous embodiments where the cup lids shown are dome shaped, cup lid 70 is flat, and is such that the cover portion 18 and the rim portion 20 lie substantially in the same plane. Further, the drinking access port 26 is defined by a tearable fold-back tab 72, such that when the fold-back tab 72 is torn and folded back, away from the rim portion 20 of the cup lid 70, the drinking access port 26 is provided. Similar to cup lids 10, 50 and 60, cup lid 70 in keeping with the present invention is thermoformed from extruded plastics sheet material. The cover portion 18, the rim portion 20, and the tearable fold-back tab 72 have an extrusion grain as indicated by arrow 73. Further, the tearable fold-back tab 72 has a longitudinal axis defined by arrow 75 which is substantially aligned with the extrusion grain. Preferably, there is provided an indentation 74 in the cover portion 18, in the region of the fold-back tab 72 opposite the rim portion 20, for receiving the fold-back tab 72 when it is folded back. The fold-back tab 72 is typically folded back about a hinge. Preferably, the hinge is a "U"-shaped hinge.

Figure 8:
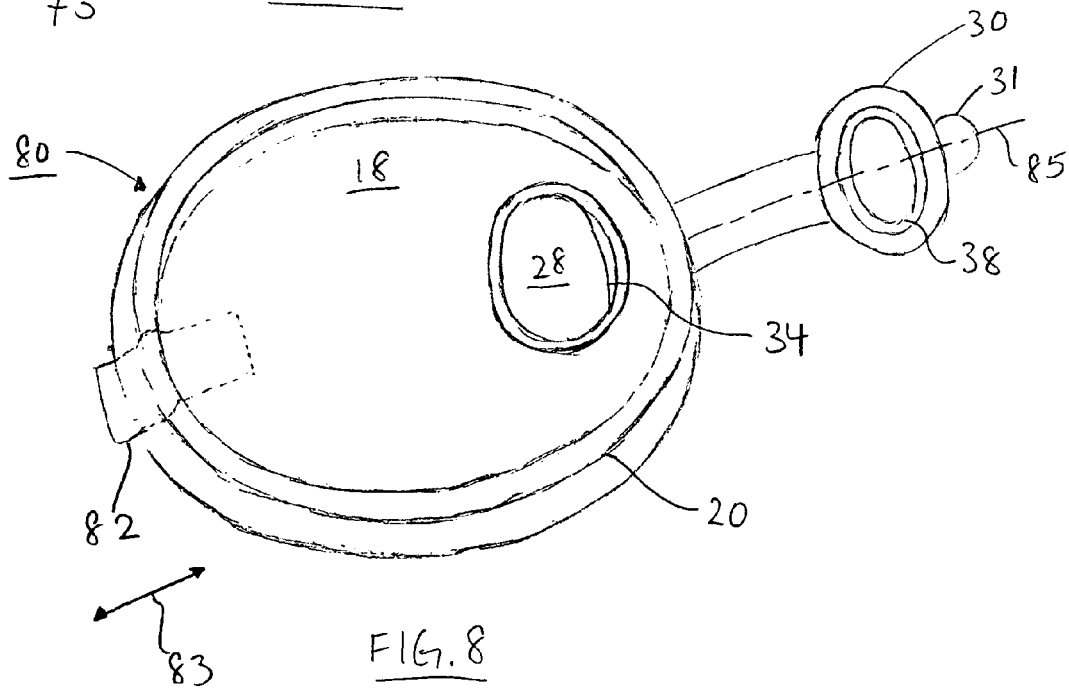
FIG. 8 is a perspective view of a fifth embodiment of a cup lid in keeping with the present invention, when the condiment opening is in its open position.

Similar to cup lid 70 shown in FIG. 7, cup lid 80 shown in FIG. 8 is also a flat lid, and thus the cover portion 18 and the rim portion 20 lie substantially in the same plane. However, in this fifth embodiment of the present invention, the drinking access port 26 of cup lid 80 is defined by a tear tab 82. When the consumer is ready to consume the beverage contained in the beverage cup 14, the consumer is required to tear the tab and dislocate it away from the drinking access port 26 so as to access the drinking opening. Preferably, cup lid 80 is thermoformed from extruded plastics sheet material. Further, the cover portion 18, the rim portion 20 and the tear tab 82 have an extrusion grain as indicated by arrow 83. Moreover, the tab 82 has a longitudinal axis defined by arrow 85 which is substantially aligned with the extrusion grain.

While only specific combinations of various features and components of the present invention have been discussed herein, it will be apparent to those skilled in the art that desired subsets of the disclosed features and components and/or alternative combinations of these features and components can be utilized, as desired.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A cup lid for placement onto the rim of a drinking cup having a substantially circular opening at its upper end, comprising: a cover portion having two equal sides with a drinking access port defined therein and located on a first side, and a condiment opening defined therein and located substantially on an opposite second side, the condiment opening being substantially opposite from the drinking access port; a rim portion around the periphery of the cover portion, and sealingly securable to the upper end of the drinking cup; and a flexible arm integrally formed with the rim portion and extending outwardly therefrom, the flexible arm having a sealing member at an end remote from the rim portion for sealably closing the condiment opening when the condiment opening is not in use, wherein said condiment opening has a stiffening rib around the peripheral region thereof, and wherein said sealing member has a plug portion formed thereon which is dimensioned for fitment with said stiffening rib such that when said condiment opening is not in use, said plug portion of said sealing member frictionally engages with said stiffening rib so as to sealably close said condiment opening, and wherein said rim portion has a channel defined therein, and a skirt downwardly extending therefrom such that when said cup lid is sealingly secured to the upper end of the drinking cup, the rim of the drinking cup is received in said channel of said cup lid and frictionally fitted therein.

2. The cup lid of claim 1, wherein said cup lid is dome shaped and is such that said cover portion is disposed above said rim portion.

3. The cup lid of claim 1, wherein said drinking access port is in the peripheral region of said cover portion.

4. The cup lid of claim 1, wherein said drinking access port provides a readily accessible drinking opening.

5. The cup lid of claim 1, wherein said drinking access port is defined by a hanging chad such that when said hanging chad is dislocated downwardly from said drinking access port, a drinking opening is provided.

6. The cup lid of claim 1, wherein said flexible arm is adjacent to said condiment opening and separated therefrom by said rim portion.

7. The cup lid of claim 1, wherein said cover portion further has a recess formed therein, which is disposed in the region between said drinking access port and said condiment opening, for the accommodation of the lip of the consumer when the consumer is tilting the drinking cup and drinking from said drinking access port.

8. The cup lid of claim 1, wherein said condiment opening is a punched through opening, and wherein said sealing member has engaging means formed in the peripheral region thereof such that when said condiment opening is not in use, said engaging means of said sealing member frictionally engages with said cover portion surrounding said condiment opening so as to sealably close said condiment opening.

9. The cup lid of claim 1, wherein said sealing member further has a tab outwardly extending therefrom which aids in the closing and opening of the condiment opening.

10. The cup lid of claim 1, further comprising a tab outwardly extending from said sealing member and diametrically opposed from said flexible arm such that when said condiment opening is sealably closed by said sealing member, said tab provides a cover for said drinking access port.

11. The cup lid of claim 1, wherein said cup lid is thermoformed from extruded plastics sheet material, wherein said cover portion, said rim portion, and said flexible arm together have an extrusion grain, and wherein said flexible arm has a longitudinal axis which is substantially aligned with said extrusion grain.

12. The cup lid of claim 1, wherein said cup lid is flat and is such that said cover portion and said rim portion lie substantially in the same plane.

13. The cup lid of claim 12, wherein said drinking access port is defined by a tearable fold-back tab such tat when said fold-back tab is torn and folded back, away from said rim portion of said cup lid, a drinking opening is provided.

14. The cup lid of claim 13, wherein said cup lid is thermoformed from extruded plastics sheet material, wherein said cover portion, said rim portion, and said testable fold-back tab have an extrusion grain, and wherein said tearable fold-back tab has a longitudinal axis which is substantially aligned wit said extrusion grain.

15. The cup lid of claim 12, wherein said drinking access port is defined by a tear tab such tat when said tab is torn and dislocated away from said drinking access port, a drinking opening is provided.

16. The cup lid of claim 15, wherein said cup lid is thermoformed from extruded plastics sheet material, wherein said cover portion, said rim portion, and said tear tab have parallel extrusion grains, and wherein said tear tab has a longitudinal axis which is substantially aligned with said extrusion grain.

* * * * *